US008435074B1

(12) United States Patent
Grant et al.

(10) Patent No.: US 8,435,074 B1
(45) Date of Patent: May 7, 2013

(54) LOW-PROFILE RIGHT-ANGLE ELECTRICAL CONNECTOR ASSEMBLY

(75) Inventors: John Grant, Sherborn, MA (US); Emad Soubh, Camas, WA (US); Jason Smith, Sartell, MN (US); Emillio Billi, Novara (IT)

(73) Assignee: AirBorn, Inc., Georgetown, TX (US)

( * ) Notice: Subject to any disclaimer, the term of this patent is extended or adjusted under 35 U.S.C. 154(b) by 0 days.

(21) Appl. No.: 13/296,166

(22) Filed: Nov. 14, 2011

(51) Int. Cl.
*H01R 13/648* (2006.01)

(52) U.S. Cl.
USPC ..... 439/607.23; 439/607.29

(58) Field of Classification Search ..... 439/607.05–607.15, 607.23, 607.25, 439/607.28, 607.29, 607.35–607.4
See application file for complete search history.

(56) References Cited

U.S. PATENT DOCUMENTS

| | | | | |
|---|---|---|---|---|
| 5,385,490 | A * | 1/1995 | Demeter et al. | 439/579 |
| 6,273,762 | B1 * | 8/2001 | Regnier | 439/701 |
| 6,361,374 | B1 * | 3/2002 | Lloyd et al. | 439/701 |
| 6,623,300 | B2 * | 9/2003 | Sakurai et al. | 439/607.25 |
| 6,685,510 | B1 * | 2/2004 | Wu | 439/607.06 |
| 6,699,072 | B1 * | 3/2004 | Wu | 439/607.07 |
| 6,699,073 | B1 * | 3/2004 | Wu | 439/607.06 |
| 6,780,069 | B2 * | 8/2004 | Scherer et al. | 439/752 |
| 6,831,840 | B2 * | 12/2004 | Ruff | 361/759 |
| 6,870,746 | B2 * | 3/2005 | Leeson et al. | 361/816 |
| 7,273,391 | B2 * | 9/2007 | Purwin | 439/502 |
| 7,364,441 | B2 * | 4/2008 | Le et al. | 439/79 |
| 7,422,490 | B2 * | 9/2008 | Droesbeke et al. | 439/701 |
| 7,485,012 | B2 * | 2/2009 | Daugherty et al. | 439/701 |
| 7,651,359 | B2 * | 1/2010 | Scherer et al. | 439/345 |
| 7,744,385 | B2 * | 6/2010 | Scherer | 439/101 |
| 7,744,414 | B2 * | 6/2010 | Scherer et al. | 439/607.05 |
| 8,210,876 | B2 * | 7/2012 | Derks et al. | 439/607.06 |
| 2002/0111067 | A1 * | 8/2002 | Sakurai et al. | 439/607 |
| 2004/0110420 | A1 * | 6/2004 | Wu | 439/608 |
| 2004/0259420 | A1 * | 12/2004 | Wu | 439/608 |
| 2006/0105597 | A1 * | 5/2006 | Purwin | 439/79 |
| 2007/0099475 | A1 * | 5/2007 | Le et al. | 439/377 |
| 2008/0009191 | A1 * | 1/2008 | Van Den Heuvel et al. | 439/608 |
| 2009/0233480 | A1 * | 9/2009 | Feldman et al. | 439/497 |
| 2010/0009571 | A1 * | 1/2010 | Scherer et al. | 439/607.05 |

OTHER PUBLICATIONS

FCI, Densishield I/O System, Brochure, pp. 1-2.
Klang, Molex, iPass+ HD 0.75 mm Pitch I/O Connector System, Product Specification, Jan. 18, 2011, pp. 1-17.

* cited by examiner

*Primary Examiner* — Ross Gushi
(74) *Attorney, Agent, or Firm* — Locke Lord LLP

(57) ABSTRACT

A low-profile, right angle connector assembly comprises six cable connectors and six board-mount connectors housed within a PCIe bracket and EMI shell. The PCIe bracket and EMI shell are braced to a low profile PCIe card. Each board-mount connector is designed to receive a cable connector and allows for the transmission and processing of high-speed data with lower latency.

11 Claims, 7 Drawing Sheets

LOW-PROFILE RIGHT-ANGLE ELECTRICAL CONNECTOR ASSEMBLY

BACKGROUND OF THE INVENTION

1. Field of Invention

The present invention is directed to a low-profile right angle electrical connector assembly having six board-mount connectors that allow for the right angle connection of cable connectors to a low profile Peripheral Component Interconnect Express ("PCIe") card such that the assembly has a total of 48 differential pairs.

2. Description of Related Art

Traditional connectors, such as FCI's Densishield™ and Molex's iPass+™, only contain four board-mount connectors. Even with eight differential pairs per connector, these other connector assemblies would only have a total of thirty-two differential pairs. Thus, to accommodate high-bit processing with these other connector assemblies while also carrying out necessary clocking operations, the transmission of the data signals must be interrupted. These traditional connector assemblies result in undesirable latency (i.e., reduction in the speed and processing of data). Connectors that use four connectors are capable of transmitting data at 64-bits, but to clock the system, data transmission or streaming must be interrupted so that at least one of the four connectors can be used for clocking purposes. This interruption in data streaming results in increased latency. In contrast, the present invention's six connectors allow for continuous and uninterrupted data transmission or streaming at 64-bits with four of the connectors while a fifth connector is used for clocking purposes at every cycle if needed. The sixth connector can be used to synchronize data transmission or clocking. The six connector configuration can provide at least 40-50 uS in decreased latency. The present inventions data rate is estimated to be approximately 50% greater than that of four-connector assemblies.

Thus, there is a need in the art for an increased number of board-mount connectors that allow for the right angle connection to a corresponding number of cable connectors while maintaining signal fidelity and meeting the low profile PCIe card requirements.

SUMMARY

The present invention is a low-profile right-angle connector assembly with six board-mount connectors that allow cable connectors to connect to a low profile PCIe card. The six board-mount connectors are housed within a PCIe bracket and an electro-magnetic insulating ("EMI") shell that are braced to the low profile PCIe card. Each of the six board-mount connectors has eight differential pairs and allows for the high-speed transmission and processing of signals with little or no undesirable latency.

The present invention improves upon prior similar connector assemblies because it has six board-mount connectors instead of four. The four-connector configuration requires interruption of the transmission of high-speed 64-bit signals to use one of the connectors for clocking operations, which results in undesirable latency. The present invention allows for the complete transmission and processing of high-speed 64-bit signals with little latency while meeting the low profile PCIe card requirements.

BRIEF DESCRIPTION OF THE DRAWINGS

The apparatus of the invention is further described and explained in relation to the following figures of the drawing wherein.

DETAILED DESCRIPTION OF THE PREFERRED EMBODIMENTS

Figure 1:
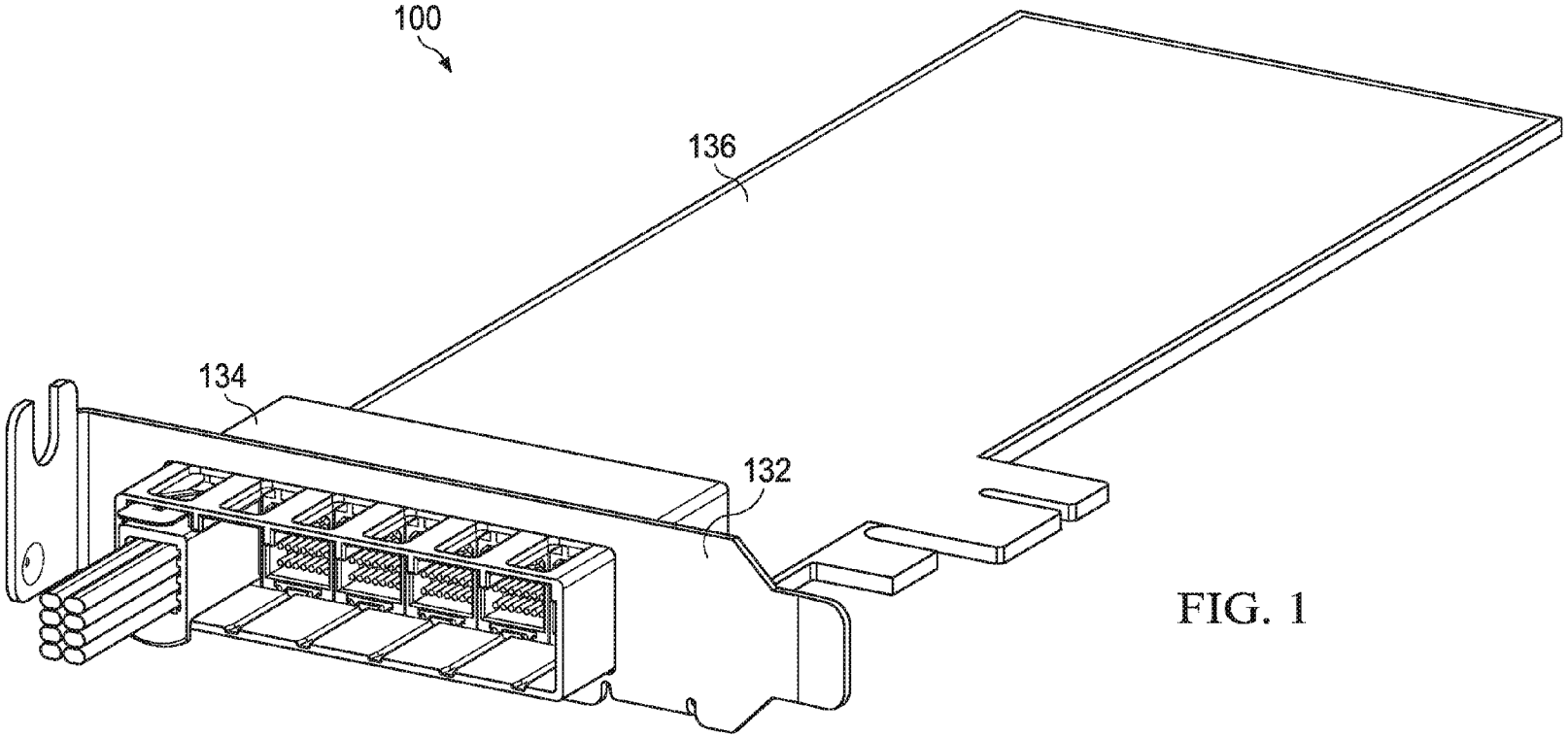
FIG. 1 is a top perspective view of the low-profile right-angle connector assembly with one cable connector plugged into a board-mount connector.
Figure 2:
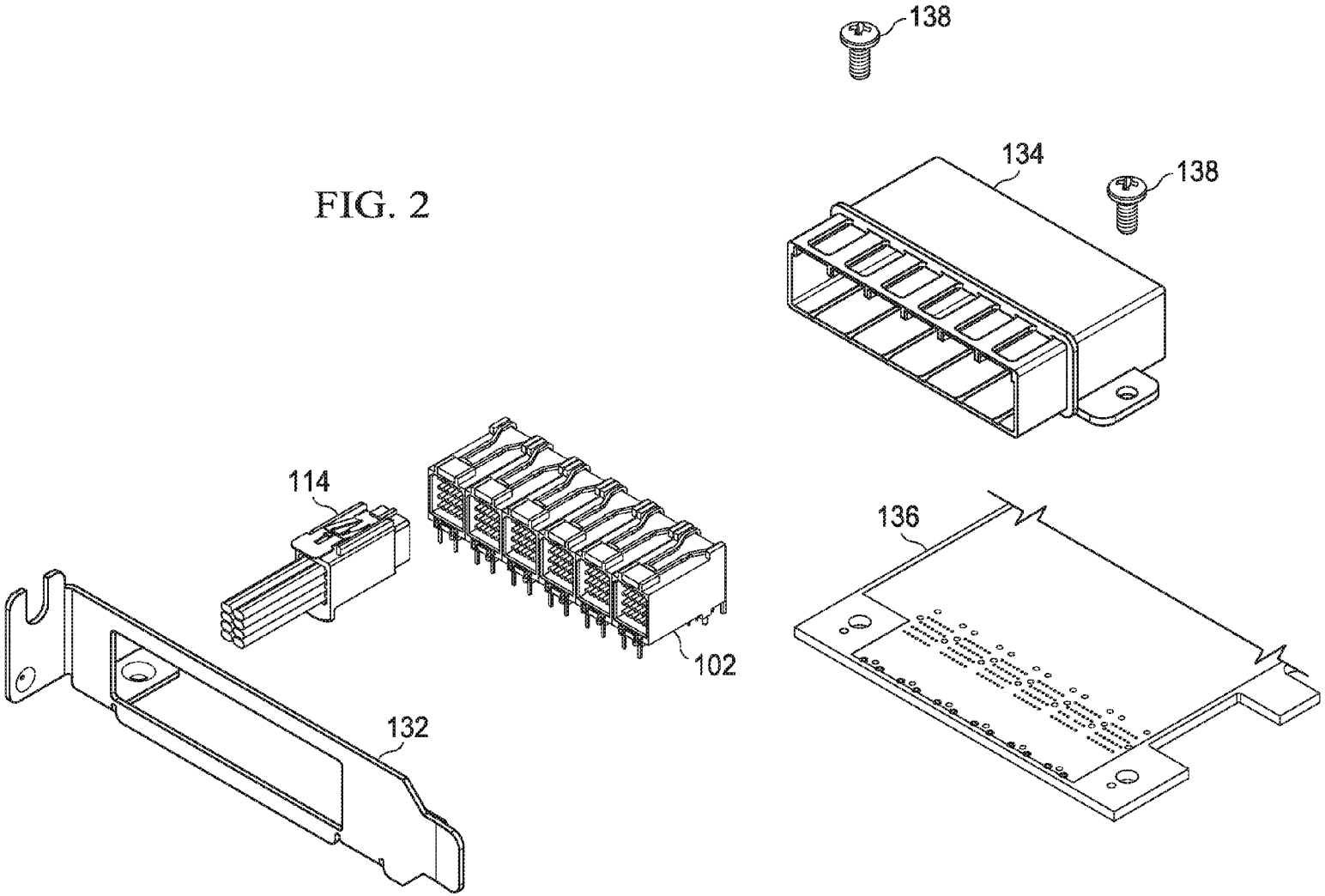
FIG. 2 is an exploded top perspective view of the low-profile right-angle connector assembly.

As shown in at least FIGS. 1, 2, 6, and 7, low-profile right-angle electrical connector assembly 100 comprises six board-mount connectors 102, six cable connectors 114, a PCIe bracket 132, and an EMI shell 134. The six board-mount connectors 102 are housed within EMI shell 134, which is braced by PCIe bracket 132. As shown in FIG. 2, bracket screws 138 pass through holes in PCIe bracket 132 and EMI shell 134 to secure board-mount connectors 102 to a low profile PCIe card 136. Board-mount connectors 102 have board-mount contacts 108 and can be either male connectors where board-mount contacts 108 are pin contacts, or board-mount connectors 102 can be female connectors where board-mount contacts 108 are socket contacts. Likewise, cable connectors 114 have cable contacts 126 and can be either male connectors where cable contacts 126 are pin contacts, or cable connectors 114 can be female connectors where cable contacts 126 are socket contacts.

Low profile PCIe add-in cards are governed by the industry standards set forth in the PCI Express® Card Electromechanical Specification. In particular the standard sets forth height, length, width, and other form factor parameters in the section titled "Add-in Card Form Factors and Implementation."

Figure 3:
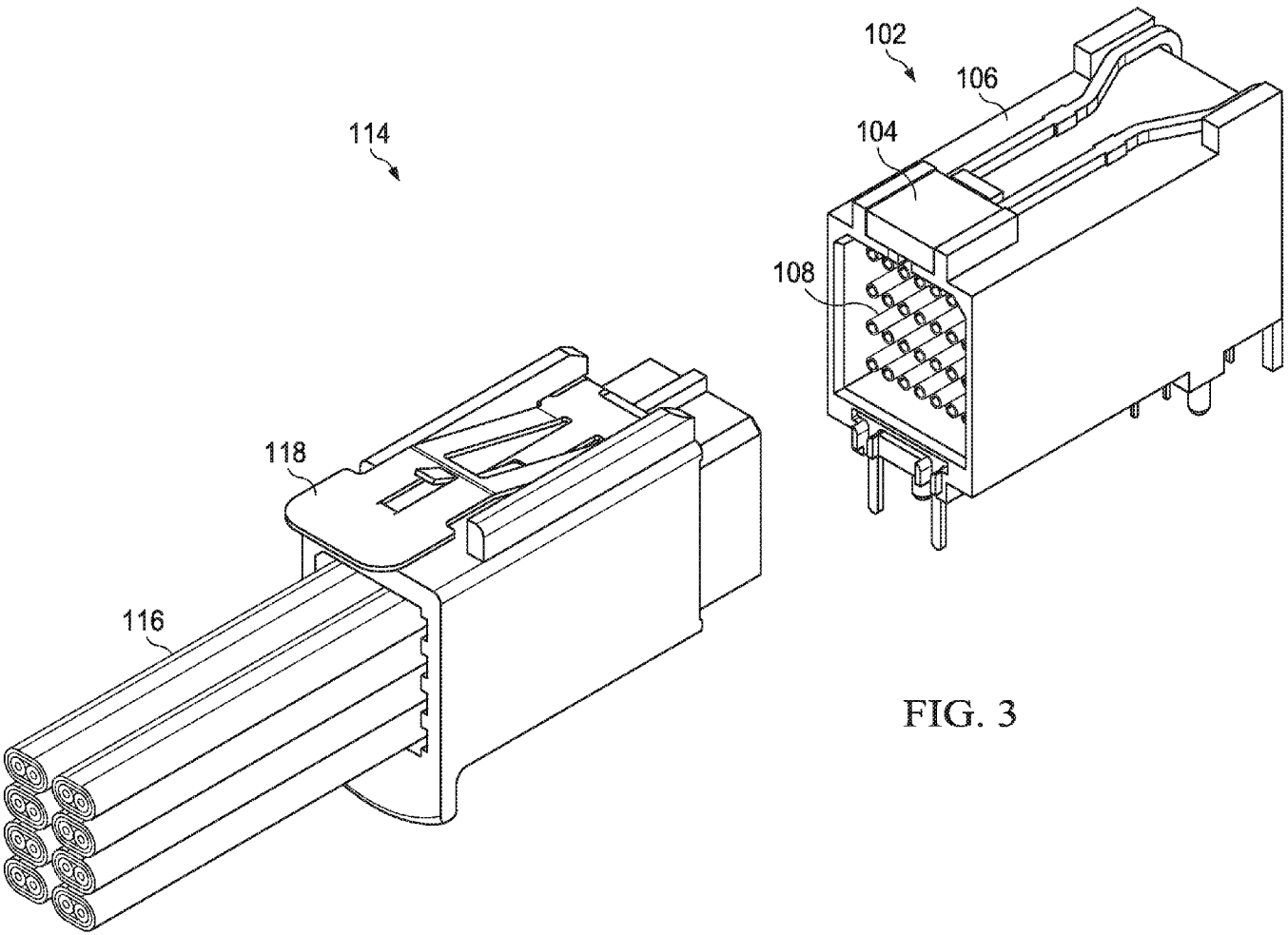
FIG. 3 is a top perspective view of a board-mount connector and a cable connector in mating orientation.
Figure 6:
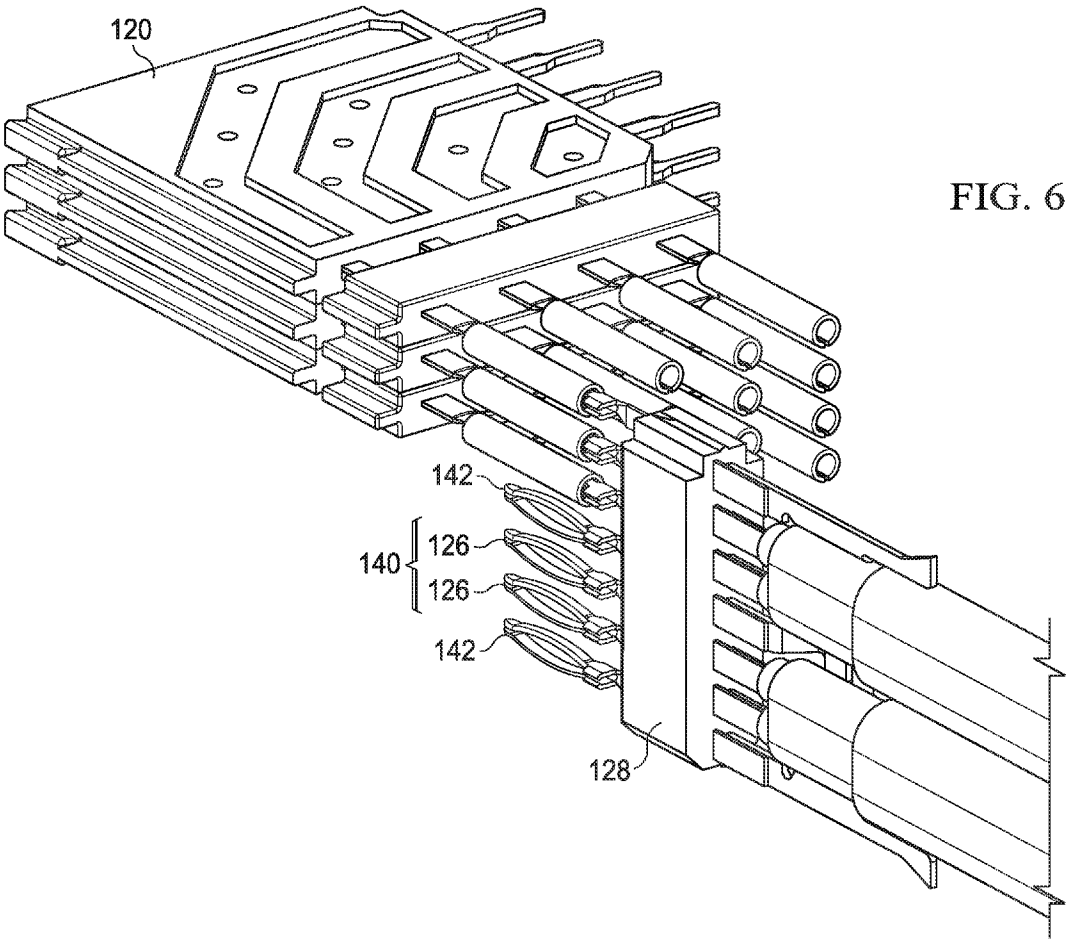
FIG. 6 is a perspective view of a ground strap securing two cable members with the contacts of the cable members and ground strap inserted into three overmolded lead frames.
Figure 7:
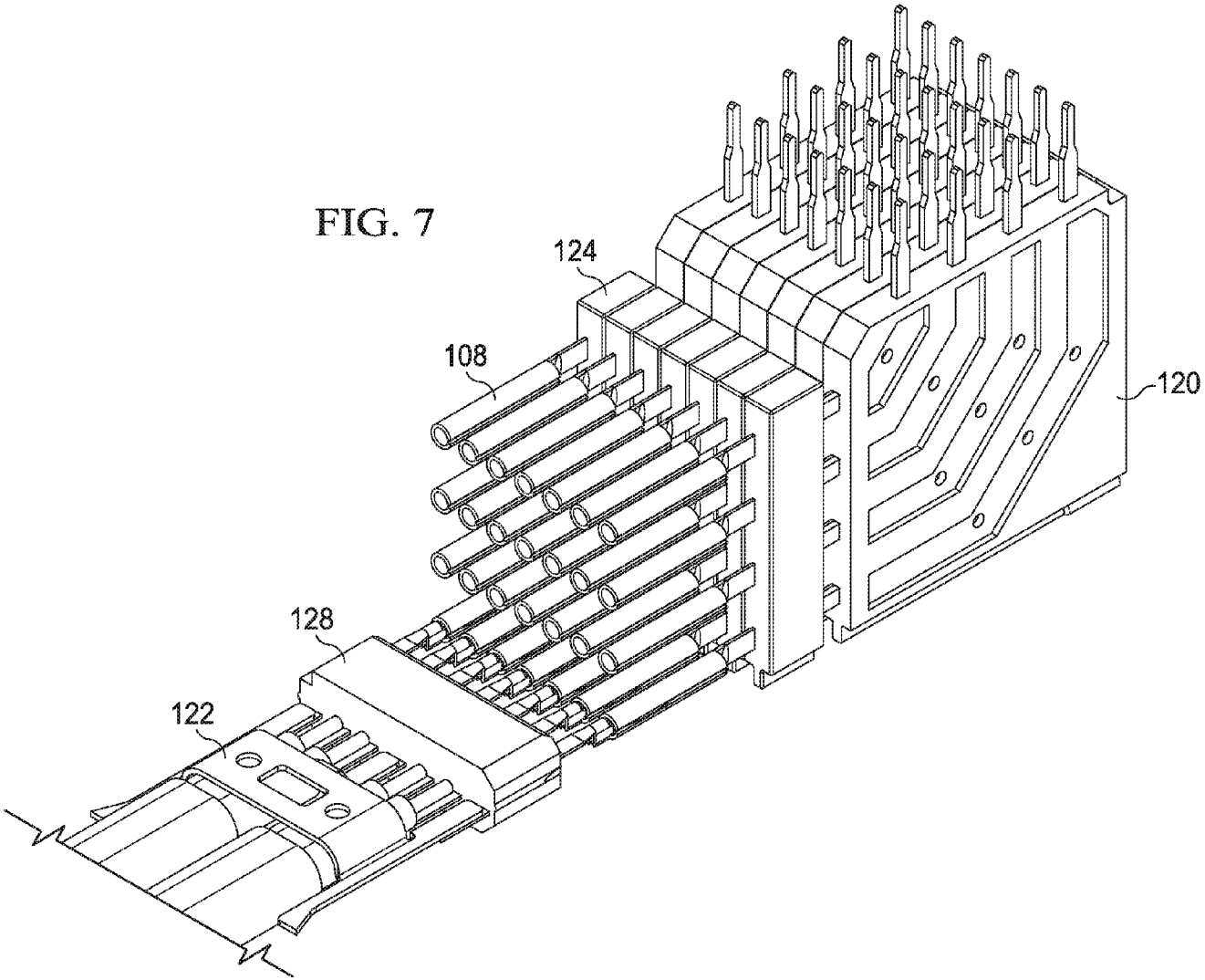
FIG. 7 is a perspective view of a ground strap securing two cable members with the contacts of the cable members and ground strap inserted into seven overmolded lead frames.
Figure 8:
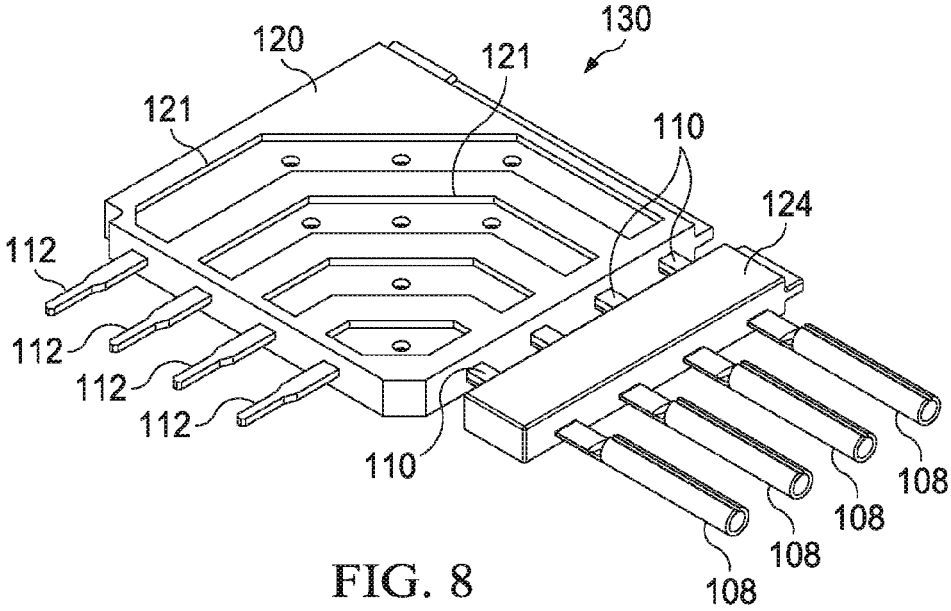
FIG. 8 is a top perspective view of an overmolded lead frame.
Figure 9:
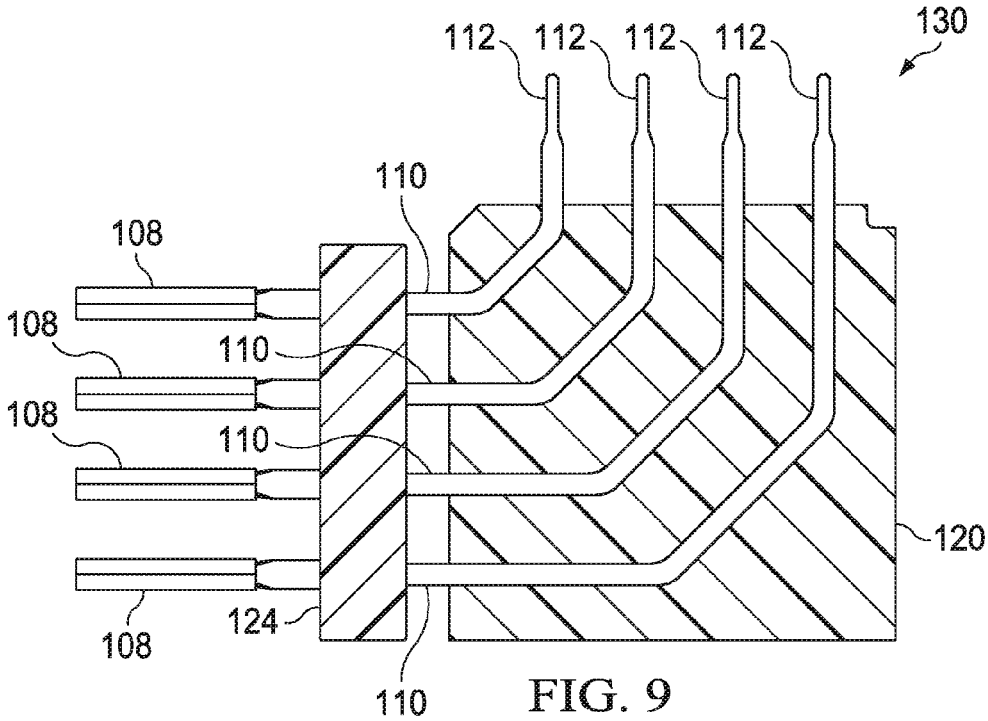
FIG. 9 is a cross-section top elevation view of an overmolded lead frame.

As shown in FIG. 3, each board-mount connector 102 can include an LED 104. As shown in FIG. 6, seven lead frame assemblies 128 can be disposed within a housing 106. Each lead frame assembly 130 comprises a lead frame 120 and either a socket wafer 124 (as shown in FIG. 7) or a pin wafer 128, depending on whether board-mount connector 102 is male or female. In another embodiment, each lead frame assembly 130 only comprises a lead frame 120 without either a socket wafer 124 or a pin wafer 128. As shown in FIGS. 8 and 9, lead frames 120 are desirably overmolded lead frames. Each lead frame 120 has four attachment terminals 112 and four attachment tabs 110. The attachment terminals 112 extend from a side of lead frame 120 that is perpendicular to the side where the attachment tabs 110 are disposed. In one preferred embodiment, a socket wafer 124 is attached to attachment tabs 110. Extending from socket wafer 124 are four board-mount contacts 108. Board-mount contacts 108 are desirably differential pair socket contacts. As shown in at least FIG. 8, each lead frame 120 features a series of depressions 121, which allow adjacent lead frames 120 to be positioned closer together, thereby resulting in a tighter pitch. The depressions 121 preferably follow the path of the electrical leads through lead frame 120. This tighter pitch contributes toward the compactness of the invention and the ability to utilize this configuration while meeting PCIe low-profile industry standards. Additionally, depressions 121 create physical air pockets that increase impedance and decrease the effective dielectric constant. Increasing impedance and decreasing the effective dielectric constant results in the preservation of signal integrity and fidelity while transmitting data at high speeds.

Figure 5:
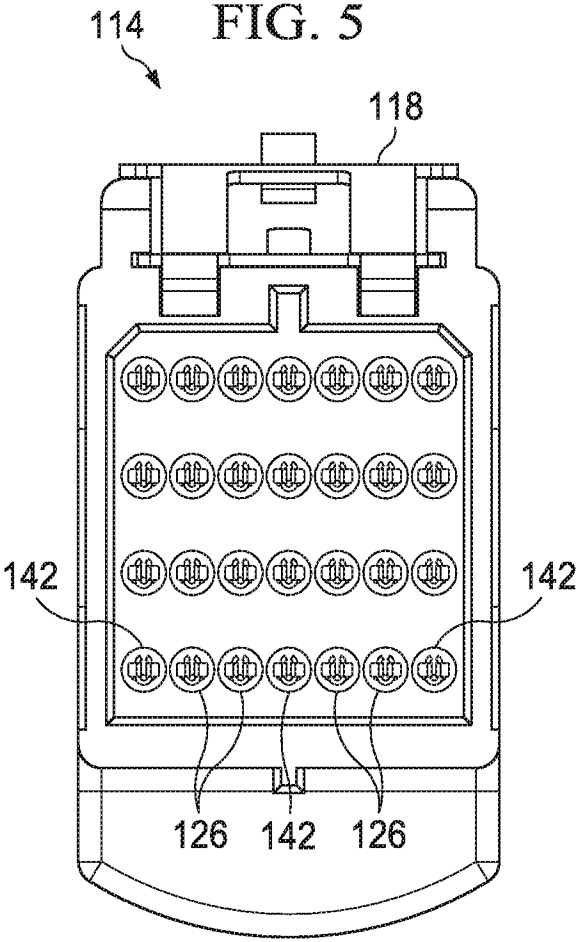
FIG. 5 is a front elevation view of a cable connector.

As shown in FIG. 3, in one preferred embodiment, each board-mount connector 102 receives a cable connector 114. Cable connector 114 features a latch 118 and houses the terminal ends of cable members 116. Cable members 116 can be twin axial cables. As shown in FIGS. 5 and 6, each cable member 116 terminates in two cable contacts 126. As shown in FIG. 6, cable contacts 126 are desirably differential pair contacts 140. In other words, each cable member 116 terminates in one differential pair 140 of one positive and one negative cable contact 126. As shown in FIG. 3, each cable connector 114 houses the terminal ends (i.e., pair-pins) of eight cable members 116. As shown in FIG. 7, ground strap 122 can secure two cable members 116 together. As shown in FIGS. 5 and 6, ground strap 122 also has three ground pins 142 that separate the differential pairs 140 of each cable member 116. The four cable contacts 126 of both cable members 116 (two pair-pins per cable member) and the three ground pins 142 of ground strap 122 pass through and are secured by pin wafer 128.

Figure 4:
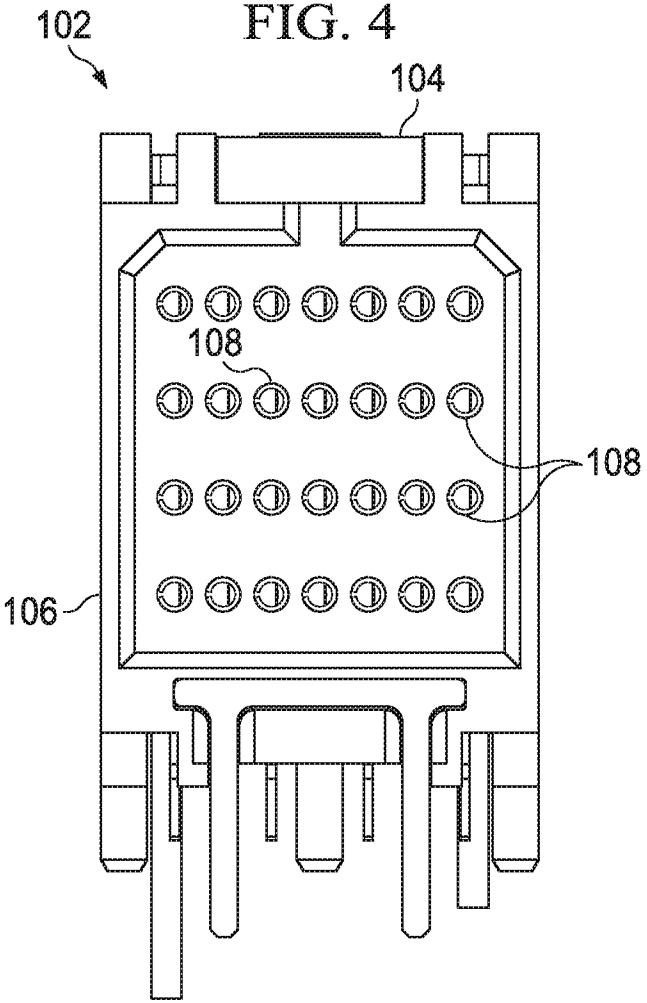
FIG. 4 is a front elevation view of a board-mount connector.

As shown in FIGS. 4 and 5, board-mount contacts 108 are adapted to receive cable contacts 126 and ground pins 142. As shown in FIGS. 7 and 8, the attachment tabs 110 of the first, third, and seventh lead frames 120 are designed to receive signals from ground contacts, such as ground pins 142. The attachment tabs 110 of the second and fifth lead frames 120 are designed to receive signals from positive contacts. The attachment tabs 110 of the third and sixth lead frames 120 are designed to receive signals from negative contacts.

The electrical connector assembly 100 of the present invention allows for an electrical connection to made from a cable members 116 to a low profile PCIe card 136. A data signal travels from cable members 116 to cable contacts 126 of cable connector 114. The data signal is transmitted from cable contacts 126 to board-mount contacts 108 of board-mount connector 102. The signal is then transmitted to attachment tabs 110 and through lead frame 120 to attachment terminals 112. Finally, the signal is transmitted from attachment terminals 112 to low profile PCIe card 136.

The present invention provides benefits at least in the forms of lower latency, lower power consumption, and more efficient coherent memory sharing while preserving signal fidelity and integrity.

As an example of the benefits provided, the present invention allows for the transmission or processing of 64-bit signals using a low profile PCIe card 136. To accomplish this level of processing, forty-eight differential pairs are needed for connector assembly 100. The forty-eight differential pairs are achieved by using the six board-mount connectors 102, each of which has eight differential pairs. The present invention thus allows for transmission and processing of 64-bit signals, which results in no to very little latency. Connectors with only four board-mount connectors are estimated to achieve speeds of about 100-500 cycles per second whereas the present invention is estimated to be able to achieve speeds of about 1,000 to 2,000 cycles per second. Additionally, currently available four-connector assemblies require additional space over the board-mount connector to attach an LED. In some situations this can cause the connector to be out of compliance with the PCIe industry standard. In contrast, the present invention provides increases in data rate transmission (of about 50%), decreases in latency, and an included LED all while maintaining compliance with the PCIe industry standard.

The invention claimed is:

1. An electrical connector assembly affording a right angle electrical connection to a low profile PCIe printed circuit board, said connector assembly comprising:

six board-mount connectors;

six cable connectors each detachably coupled to one of said board-mount connectors;

a PCIe bracket; and an EMI shell;

wherein each board-mount connector comprises seven lead frame assemblies disposed within a housing;

wherein the board-mount connectors are housed within the EMI shell, which is braced by the PCIe bracket to the PCIe printed circuit board; and wherein each cable connector houses the terminal ends of eight cable members.

2. The electrical connector assembly of claim 1 wherein the board-mount connectors are male connectors having pin contacts.

3. The electrical connector assembly of claim 1 wherein the board-mount connectors are female connectors having socket contacts.

4. The electrical connector assembly of claim 1 wherein the cable connectors are male connectors having pin contacts.

5. The electrical connector assembly of claim 1 wherein the cable connectors are female connectors having socket contacts.

6. The electrical connector assembly of claim 1 wherein each one of the seven lead frame assemblies comprises a lead frame and a pin wafer.

7. The electrical connector assembly of claim 1 wherein each one of the seven lead frame assemblies comprises a lead frame and a socket contact.

8. The electrical connector assembly of claim 7 wherein said lead frames further comprise a depression.

9. The electrical connector assembly of claim 1 wherein each board-mount connector comprises an LED.

10. The electrical connector assembly of claim 1 wherein each cable connector comprises a latch.

11. The electrical connector assembly of claim 1 wherein each cable connector comprises a ground strap having three ground pins and securing two cable members together.

* * * * *